US012227268B1

(12) United States Patent
Klausky et al.

(10) Patent No.: US 12,227,268 B1
(45) Date of Patent: Feb. 18, 2025

(54) CONVERTIBLE SEATING FOR BOATS

(71) Applicant: Brunswick Corporation, Mettawa, IL (US)

(72) Inventors: Matthew P. Klausky, Port Orange, FL (US); Prasad Dhananjay Deole, Winter Springs, FL (US)

(73) Assignee: Brunswick Corporation, Mettawa, IL (US)

( * ) Notice: Subject to any disclaimer, the term of this patent is extended or adjusted under 35 U.S.C. 154(b) by 909 days.

(21) Appl. No.: 17/328,437

(22) Filed: May 24, 2021

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 29/04; B63B 2029/043
See application file for complete search history.

(56) References Cited

U.S. PATENT DOCUMENTS 3,608,684 A 9/1971 Shimanckas
3,671,071 A 6/1972 Evinrude
4,086,676 A 5/1978 Arruza
4,278,289 A 7/1981 Esposito
5,136,963 A * 8/1992 Zuzik ..... B63B 29/10 114/343
5,320,059 A 6/1994 Ikeda
5,572,944 A 11/1996 Slikkers et al.
5,795,017 A 8/1998 Zimmerman et al.
5,799,605 A 9/1998 Huse
6,041,732 A 3/2000 Ikeda
6,145,458 A 11/2000 Hattori
6,327,981 B1 12/2001 Nørregaard et al.
6,763,777 B1 7/2004 Rosenberg
6,893,305 B2 5/2005 Natsume et al.
7,513,211 B1 * 4/2009 Farb ..... B63B 29/04 114/363
7,980,628 B2 7/2011 Hu et al.
8,002,097 B2 8/2011 Tsurumi
8,113,136 B2 2/2012 Mayrand et al.
D665,719 S 8/2012 Watkins et al.
8,387,734 B2 3/2013 Krosschell et al.
8,517,466 B1 8/2013 Wizorek et al.
(Continued)

OTHER PUBLICATIONS

U.S. Pat. No. 794,777, issued Jul. 18, 1905.
(Continued)

*Primary Examiner* — S. Joseph Morano
*Assistant Examiner* — Jovon E Hayes
(74) *Attorney, Agent, or Firm* — Andrus Intellectual Property Law, LLP

(57) ABSTRACT

A convertible seating apparatus for a boat has a base, a seat, and a backrest coupled to the seat. The seat and backrest are positionable relative to the base into and between a seating position in which the backrest extends transversely upwardly relative to the seat and a lounge position in which the backrest and seat are substantially aligned. A primary locking device is movable into and between a locked position in which the seat and backrest are coupled to the base so as to lock the seat and backrest in the lounge position, and an unlocked position in which the seat and backrest are decoupled from the base so as to permit movement of the seat and backrest into and between the seating position and the lounge position.

25 Claims, 9 Drawing Sheets

(56) References Cited

U.S. PATENT DOCUMENTS

| | | | | |
|---|---|---|---|---|
| 8,585,116 | B2 | 11/2013 | King | |
| 8,899,169 | B1 | 12/2014 | Jaziri | |
| 9,003,997 | B2 | 4/2015 | Gratz et al. | |
| 9,021,975 | B1 | 5/2015 | Fodor et al. | |
| 9,073,608 | B1 * | 7/2015 | Foss | B60N 2/203 |
| 9,079,638 | B2 | 7/2015 | Ricciardi et al. | |
| D743,318 | S | 11/2015 | Curts | |
| 9,260,166 | B1 | 2/2016 | Fodor et al. | |
| 9,487,273 | B1 | 11/2016 | Eekhoff et al. | |
| 9,650,117 | B2 | 5/2017 | Curts et al. | |
| 9,821,887 | B1 | 11/2017 | Wilson et al. | |
| D830,944 | S | 10/2018 | Deurr | |
| 10,085,566 | B1 | 10/2018 | Gallant | |
| 10,336,411 | B2 | 7/2019 | Curts et al. | |
| D864,081 | S | 10/2019 | Barbier et al. | |
| 10,486,777 | B1 | 11/2019 | Barbier et al. | |
| 10,604,217 | B2 | 3/2020 | Curts et al. | |
| 11,027,795 | B2 | 6/2021 | Curts et al. | |
| 11,091,230 | B2 * | 8/2021 | Curts | B63B 29/04 |
| 11,230,355 | B1 | 1/2022 | Curts et al. | |
| 11,897,587 | B1 * | 2/2024 | Farrell | B60N 2/3013 |
| 2007/0158986 | A1 * | 7/2007 | Adams | B60N 2/36 297/342 |
| 2008/0072810 | A1 | 3/2008 | Forbes et al. | |
| 2010/0037814 | A1 | 2/2010 | Sahr et al. | |
| 2010/0319604 | A1 | 12/2010 | Mayrand et al. | |
| 2011/0088607 | A1 | 4/2011 | Kobayashi et al. | |
| 2011/0095592 | A1 | 4/2011 | Willard et al. | |
| 2013/0160695 | A1 | 6/2013 | Gratz et al. | |
| 2014/0225403 | A1 | 8/2014 | Shimada et al. | |
| 2016/0214690 | A1 | 7/2016 | Bires | |
| 2017/0297660 | A1 * | 10/2017 | Neese | B60N 2/3009 |
| 2017/0305307 | A1 * | 10/2017 | Reid | B60N 2/24 |
| 2020/0331365 | A1 | 10/2020 | Curts | |
| 2021/0284291 | A1 | 9/2021 | Curts et al. | |

OTHER PUBLICATIONS

Unpublished U.S. Appl. No. 62/046,394, filed Sep. 5, 2014.

"Glastron GT 187 Walkthru" YouTube video, retrieved from https://www.youtube.com/watch?v=3JCzEhpNF7I, published Dec. 2, 2013.

Plueddeman, "New Glastron Models for 2014: Jets, Legacy, and GTX", Boats.com, retrieved from https://www.boats.com/reviews/new-glastron-models-for-2014-jets-legacy-and-gtx/, published Sep. 8, 2013.

"Captain's Report by Capt. Steve" re: Yamaha 210 Series, BoatTest, retrieved from https://boattest.com/node/71858 on Mar. 18, 2022.

"The Layout Lowdown . . . " re: Yamaha AR210, BoatTest, retrieved from https://boattest.com/node/70523 on Mar. 18, 2022.

Concept drawings showing Princecraft Vogue 27 SE, Model Year 2014.

Mastercraft X24, available in Mastercraft.com, site visited on Feb. 3, 2023, URL:https://investors.mastercraft.com/news-releases/news-release-details/mastercrafts-new-x24-surf-boat-creates-industrys-laregst-wave (Year: 2023).

Mastercraft X26, available in Mastercraft.com, site visited on Feb. 3, 2023, URL:https://www.mastercraft.com/boats/x/ (Year: 2023).

* cited by examiner

CONVERTIBLE SEATING FOR BOATS

FIELD

The present disclosure relates to seating for boats.

BACKGROUND

The following U.S. Patents are incorporated herein by reference.

U.S. Pat. No. 5,799,605 discloses an expandable seat and storage unit particularly adapted for use in a boat. The expandable seat has a base unit which defines a storage area. A frame is slidably mounted within the base and can slide with respect to the base to expand the length of the seat to form a bed. The frame is locked into the base by the back cushion of the seat. By removing the back cushion, the frame section can be slid out of the base and then the back cushion can be used along with the seat cushion to form a bed. The frame has side members which extend generally perpendicular from the side edges of the front face of the frame and ride in tracks formed in the base unit. The tracks are along the sides of the base unit and do not interfere with the storage area. Further, the tracks are formed integrally in the base unit to facilitate easy inexpensive manufacture and operation.

U.S. Pat. No. 7,513,211 discloses a seat assembly for use in boats. The seat assembly includes a pair of seating platforms with a reclining seat back and a sliding seat bottom. A removable section is inserted between the seat bottom and the seat back to create a long recliner. A central panel and pad are set between the seating platforms to create a large surface area sunpad. The seating platforms are hollow to allow for storage of the central panels and pads and the removable sections.

U.S. Pat. No. 8,517,466 discloses a convertible boat seat that transforms from a standard bench-style seat configuration capable of accommodating multiple occupants to a lounger that allows a single occupant to comfortably lounge without impeding into the available deck space. A convertible boat seat comprises a chaise lounge type seat having a plurality of configurable components including a two-piece back rest, a configurable armrest, a hinging bench seat assembly, and an inclined chaise end forming a lounge backrest adapted with a pivoting armrest. The two-piece backrest includes first and second backrest components that are each configurable between a raised position and a lowered position. The inclined chaise end includes a pivoting armrest configurable between a stowed, out-of-the-way position, and a deployed position wherein it functions as a lounge armrest. A hinging bench seat includes first and second hingedly connected seat components that are configurable between a generally flat configuration for bench seating and a raised configuration wherein the lounger's knees are supported in a partially bent lounge position. On an opposing end of the inclined chaise end is an armrest configurable between a raised position wherein it functions as an armrest when the seat is configured for bench-style seating, and a lowered position wherein it is stowed generally flush with the bench seat surface for providing increased leg room while lounge.

U.S. Pat. No. 8,899,169 discloses a platform for a vessel that includes integrated and stowable seating. The platform comprises a platform surface, at least one seating recess, and at least one seat back panel. The seating recess is disposed below the platform surface. The seat back panel has an inner surface and an opposing outer surface and is pivotably attached to the seating recess to provide a plurality of operative positions, including an open seating position and a closed position. In the closed position, the outer surface of the seat back panel is substantially flush with respect to the platform surface, providing a continuous and unobstructed boarding/swimming platform. The open seating position provides an aftward seating configuration. Both the seating recess and seat back panel can removably receive cushions for added comfort and support of the user. The configuration maximizes usable platform space when the seat back panels are closed.

U.S. Pat. No. 9,021,975 discloses a seating system for marine vessels and watercraft including a chair having a backrest and a seat bottom and a lounge extension element wherein a first end of the extension element is hingeably attached to and extends from the seat bottom and wherein a second end of the extension element is configured to be hingeably attached to a first rigid structure such as a bulkhead on a watercraft. The seating system is convertible between a forward-facing seat configuration and an aft-facing lounger configuration. In the aft-facing lounger configuration, the extension element and the seat bottom are substantially parallel to one another. In the forward-facing seat configuration, the extension element is substantially upright and at an acute angle with respect to said seat bottom.

U.S. Pat. No. 9,073,608 discloses a seating system for watercraft having a base supporting a seating surface and a backrest pivotably attached to the base. The backrest pivots about the seating surface to provide a plurality of selectable seating positions. The backrest is pivotably attached to the base by an arm attached to the side of the backrest. The arm engages a guide member attached to the base, the guide member having one or more positional slots corresponding to the plurality of selectable seating positions. The backrest can be positioned upright, at an angle, or flat with respect to the seating surface to provide a plurality of seating configurations including simultaneous forward and aft seats, an aft-facing lounge seat and a sunpad. The seating surface comprises hingeable seat cushions permitted access to storage compartments inside the base. The seating system can be installed adjacent to a bulkhead on a watercraft to provide an aft-facing lounge seat.

U.S. Pat. No. 9,260,166 discloses a seat for a marine vessel capable of multiple positions while maintaining a hidden or concealed look when closed. The seat has a seat back hingeably attached to a seat bottom and a seat back cap hingeably attached to a leading edge of the seat back. The seat is operable between a plurality of selected positions including an open position and a closed position. In the open position, the seat back is upright and the seat provides at least one traditional seating surface. In the closed position, the seat back rests substantially parallel on the seat bottom and a rear surface of the seat back functions as a sun pad. In the closed position, the seat back cap is deployed over a leading edge of the seat bottom and the leading edge of the seat back to conceal the seat. A positionable leg extension pad extends from the seat bottom.

U.S. Pat. No. 9,821,887 discloses a convertible seating system for a marine vessel includes a frame and a seat mounted on the frame and defining a first support surface. A backrest is configured for movement relative to the seat and the frame between a first position and a second position. In the second position, the backrest defines a second support surface lying generally parallel and vertically displaced relative to the first support surface.

U.S. Pat. No. 10,085,566 discloses a marine vessel that has a deck surface having a recessed cavity, a seat module having a seating member, an engagement member, and a hinge that couples the seating member to the engagement member, and a retainer configured to retain the engagement member with respect to the recessed cavity. The seating member is pivotable about the hinge into and between a closed position in which the seating member lies flush with the deck surface and covers the recessed cavity and an open position in which the seating member provides seating for user and the recessed cavity is exposed and provides leg room for the user.

U.S. Pat. No. 10,486,777 discloses a seating system that includes a base, and a seat mounted on the base and defining a seating surface. A backrest is configured for movement relative to the base and the seat between a first position and a second position by a backrest transfer arrangement having a movable pivot axis configuration. In the second position, the backrest defines a working surface spaced above and lying generally parallel to the seating surface.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

A convertible seating apparatus for a boat has a base, a seat, and a backrest coupled to the seat. The seat and backrest are positionable relative to the base into and between a seating position in which the backrest extends transversely upwardly relative to the seat and a lounge position in which the backrest and seat are substantially aligned. A primary locking device is movable into and between a locked position in which the seat and backrest are coupled to the base so as to lock the seat and backrest in the lounge position, and an unlocked position in which the seat and backrest are decoupled from the base so as to permit movement of the seat and backrest into and between the seating position and the lounge position.

In certain examples, the convertible seating apparatus further has a secondary locking device that is movable into and between a locked position in which the seat is coupled to the base so as to lock the seat and backrest in the lounge position, and an unlocked position in which the seat is decoupled from the base so as to permit movement of the seat and backrest into and between the seating position and the lounge position Various other features, objects, and advantages of the invention will be made apparent from the following description taken together with the drawings.

BRIEF DESCRIPTION OF THE DRAWINGS

The present disclosure refers to the following drawing Figures.

DETAILED DESCRIPTION

During research and development, the present inventors determined that it would be desirable to provide improved seating apparatuses for boats that are easily convertible from a seating orientation into a functional sunlounge orientation. It was found to be desirable to configure such apparatuses so that the occupant has the option to easily raise and lower the seating and backrest surfaces into and out of a uniform sunlounge surface on which the occupant can stand, sit, or lie down, for example during sunbathing.

Figure 1:
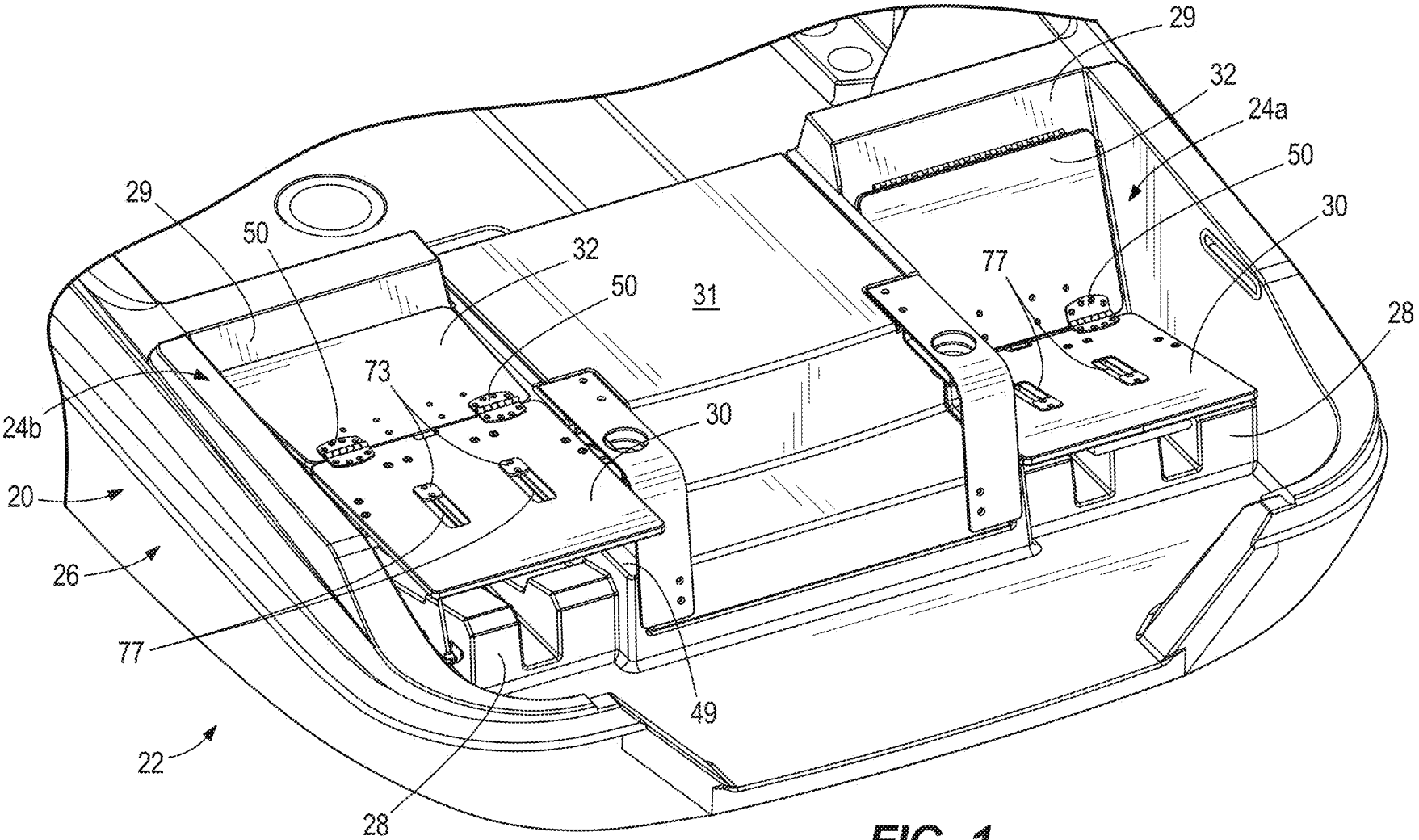
FIG. 1 is a perspective view of a boat having a pair of convertible seating apparatuses, including a convertible seating apparatus shown in a seating position and a convertible seating apparatus shown in a lounge position.

FIG. 1 depicts the stern 20 of a boat 22 and a pair of convertible seating apparatuses 24*a*, 24*b* configured according to the present disclosure. The apparatuses 24*a*, 24*b* are located on the starboard side and port side of the boat 22, respectively. The starboard-side apparatus 24*a* is shown in a seating position whereupon an occupant can sit with his or her back being supported while facing aftwardly relative to the boat 22. The port-side apparatus 24*b* is shown in a lounge position whereupon the occupant can sit, stand or lie in a prone position, for example during sunbathing.

In the examples described herein below, the hull 26 of the boat 22 provides a rigid frame or base 28 that supports the apparatuses 24*a*, 24*b* in both the seating and lounge positions. The boat 22 has a deck that provides a rigid headrest 29 on which the occupant can rest his or her head in both of the seating and lounge positions. A center console 31 is also provided between the apparatuses 24*a*, 24*b*, including an arm rest and cupholders, etc.

It should however be understood that in other examples, the base could be provided by any other suitable support structure(s) instead of or in addition to the hull, for example one or more supporting frame(s) and/or the like. It should also be understood that the type and configuration of the boat 22 can vary from what is shown, and that the location of the seating apparatus(es) can vary from what is shown. In other examples, there could be only one seating apparatus or any other number of seating apparatuses. Also, the apparatuses 24*a*, 24*b* shown in FIG. 1 are mirror images of each other and the description provided herein below regarding the "apparatus 24" applies to both apparatuses 24*a*, 24*b*.

Figure 2:
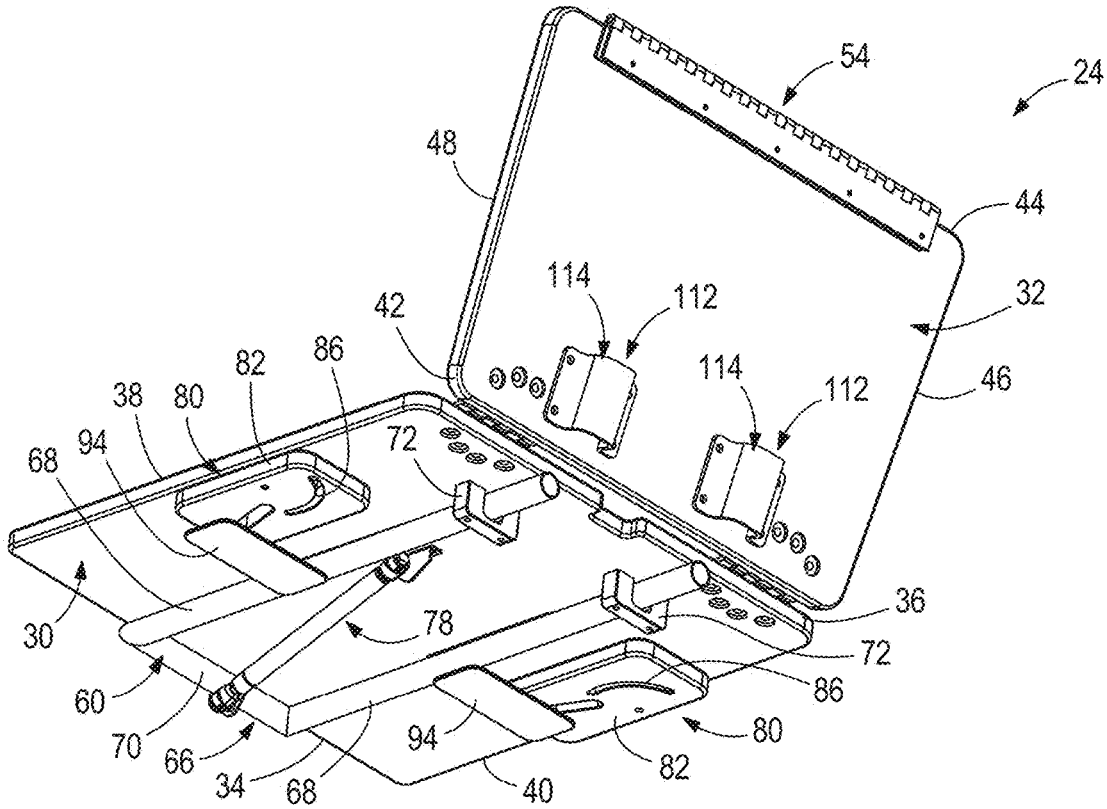
FIG. 2 is a perspective view looking up at the convertible seating apparatus in the seating position.
Figure 3:
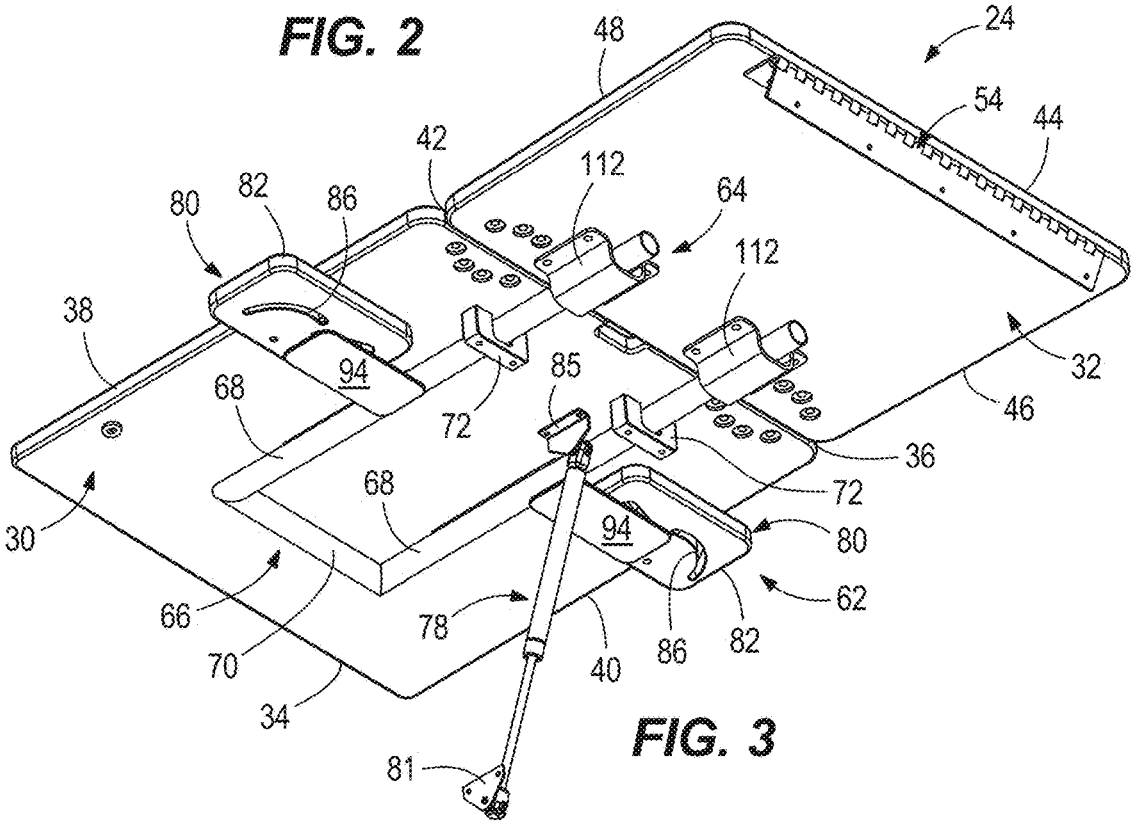
FIG. 3 is a perspective view looking up at the convertible seating apparatus in the lounge position.
Figure 4:
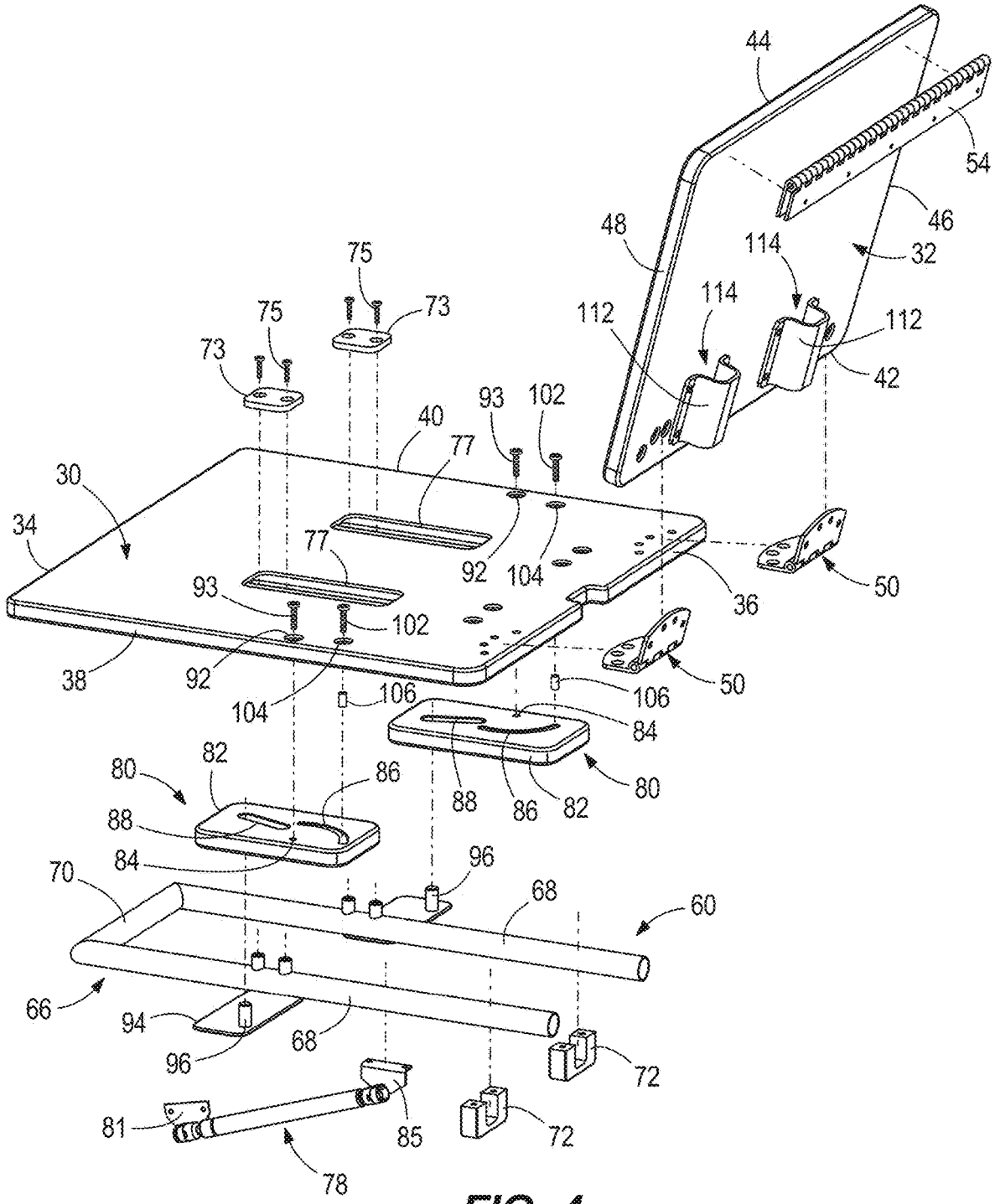
FIG. 4 is an exploded view of the convertible seating apparatus.

Referring to FIGS. 2-4, each apparatus 24 includes a seat 30 and a backrest 32, which are rectangular plate-like members. The seat 30 extends from front 34 to rear 36 and transversely from a first side 38 to an opposite, second side 40. The backrest 32 extends from front 42 to rear 44 and transversely from a first side 46 to an opposite, second side 48. A pair of hinges 50 pivotably connect the rear 36 of the seat 30 to the front 42 of the backrest 32 and define a first pivot axis or first pivot joint 52 (see FIG. 5) about which the seat 30 can pivot up and down relative to the backrest 32. A continuous or piano-style hinge 54 pivotably connects the rear 44 of the backrest 32 to the base 28 and defines a second pivot axis or second pivot joint 56 (see FIG. 5) about which both the seat 30 and backrest 32 can pivot up and down relative to the base 28. It should be understood that the type and configuration of pivotable connection can vary from what is shown.

Figure 5:
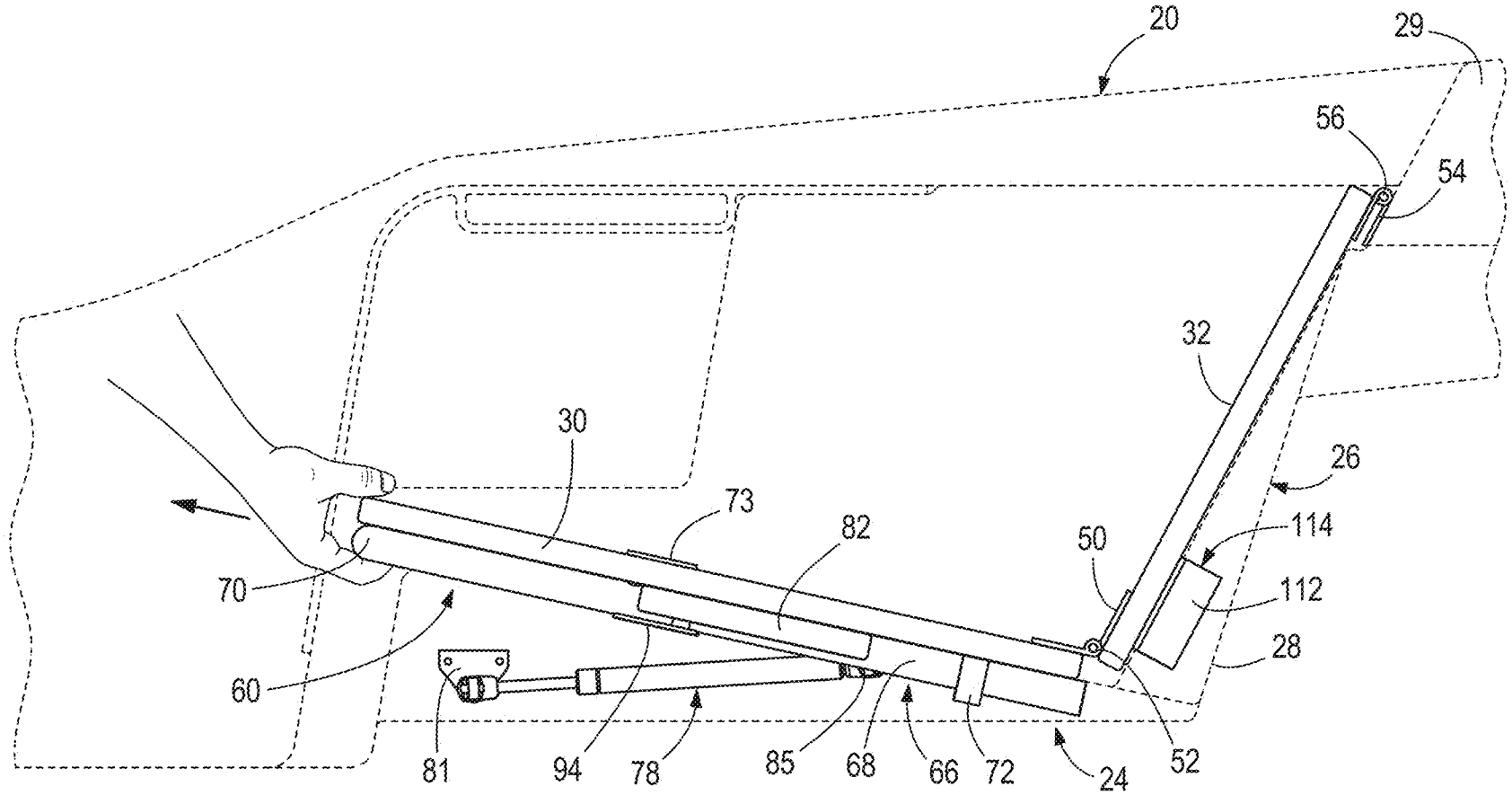
FIG. 5 is a side view of the boat and convertible seating apparatus in the seating position.
Figure 7:
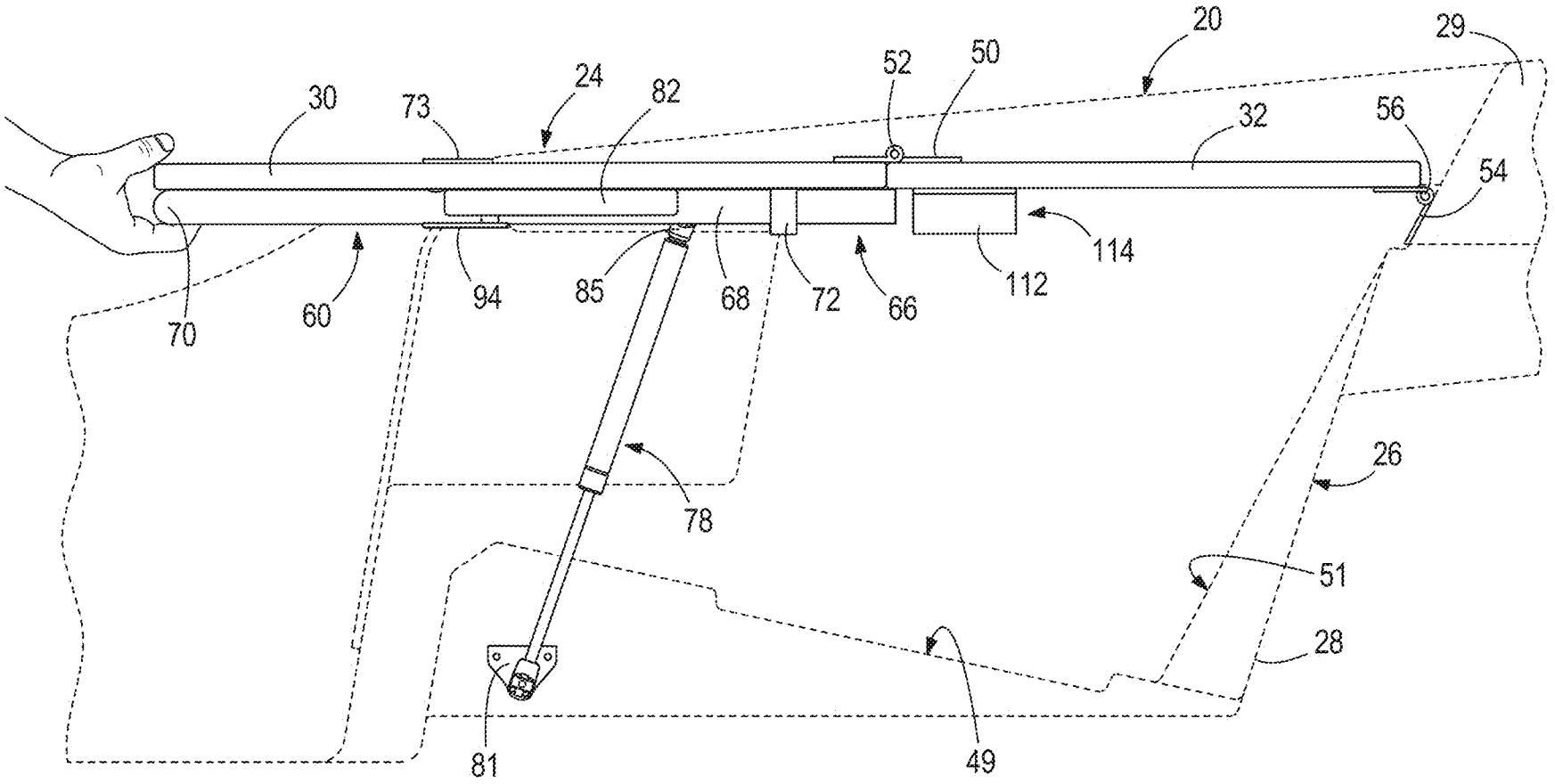
FIG. 7 is a side view showing continued movement of the convertible seating apparatus into the lounge position.
Figure 8:
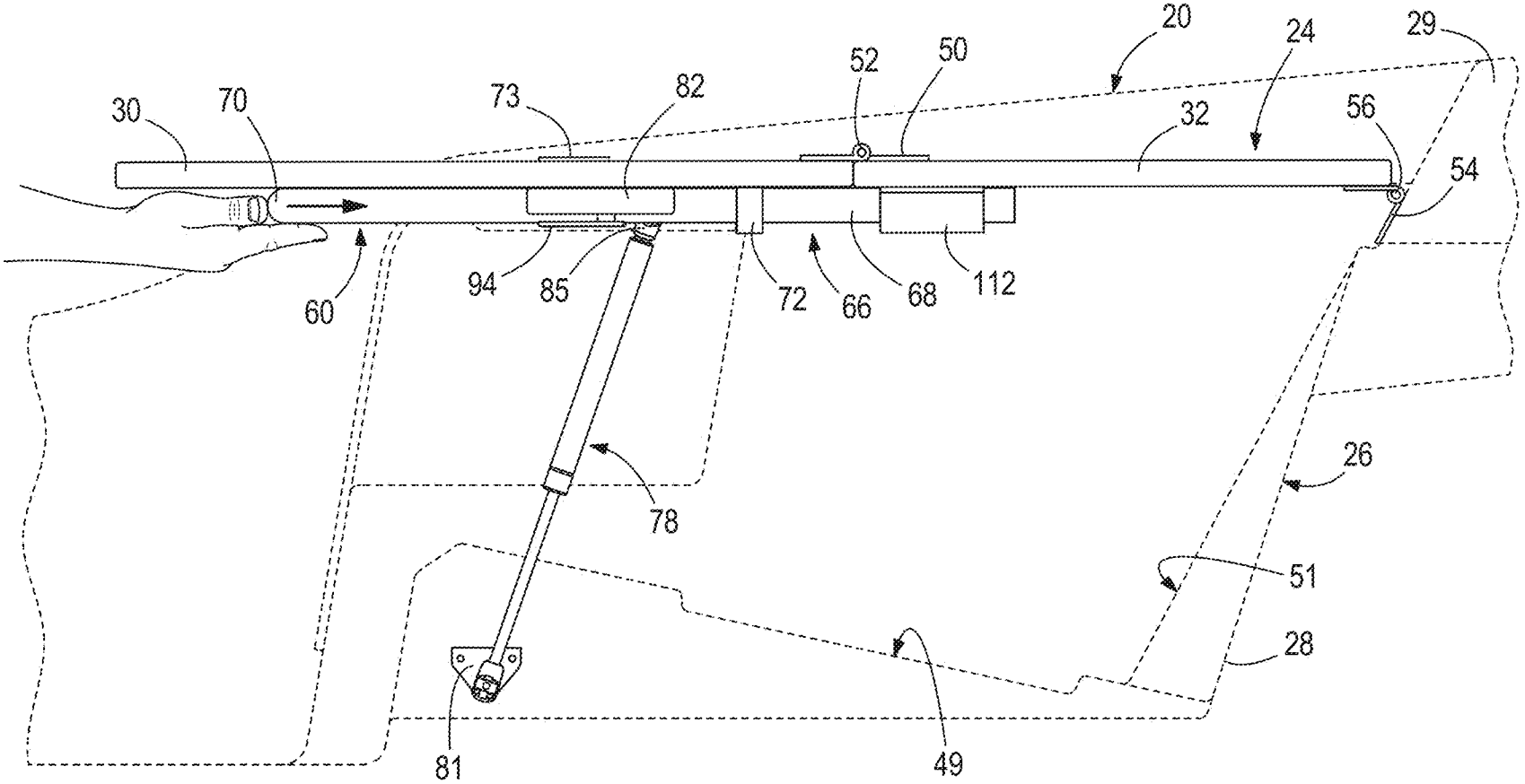
FIG. 8 is a side view showing locking of primary and secondary locking devices for retaining the convertible seating apparatus in the lounge position.

In the seating position (FIG. 2), the backrest 32 extends transversely upwardly relative to the seat 30. In the lounge position (FIG. 3), the backrest 32 and seat 30 are both raised relative to the seating position and are substantially aligned with each other or parallel so as to provide a uniform or flat lounge surface. When the apparatus 24 is moved into and between the seating position and the lounge position (see FIGS. 5-8), the seat 30, the first pivot joint 52 and the backrest 32 are pivoted upwardly about the second pivot joint 56. As shown in FIG. 5, the first pivot joint 52 is in a lowered position when the seat 30 and backrest 32 are in the seating position. Conversely, as shown in FIG. 8, the first pivot joint 52 is in a raised position when the seat 30 and backrest 32 are in the lounge position.

Referring to FIGS. 2-4, a manually-operable handle actuator 60 is slide-ably mounted to the bottom of the seat 30. As will be further described herein below, the handle actuator 60 enables the occupant to easily move the apparatus 24 into and between the seating position and the lounge position. The handle actuator 60 also advantageously enables the occupant to easily lock and unlock the apparatus 24 relative to the lounge position in a single motion, via both primary and secondary locking devices 62, 64, which will be further described herein below with reference to FIGS. 8-10.

With continued reference to FIG. 4, the handle actuator 60 includes an elongated, U-shaped handlebar 66 disposed on the bottom of the seat 30. The handlebar 66 has a parallel pair of arms 68 and a cross-bar or handle member 70 which connects the forward ends of the arms 68. The handle member 70 is wide enough to enable manual grasping and sliding (pushing/pulling) of the handlebar 66 forwardly and backwardly along the bottom of the seat 30. A pair of slide brackets 72 are fastened to the bottom of the seat 30 and permit the noted sliding movement of the handlebar 66, as shown by the arrow in FIG. 5. The arms 68 are also slide-ably connected to the seat 30 by a pair of backing brackets 73 fastened to the arms 68 by fasteners 75 extending through slots 77 in the seat 30. Together with the slide brackets 72, the backing brackets 73, fasteners 75 and slots 77 retain the handlebar 66 on the bottom of the seat 30 and also facilitate and guide back and forth sliding movement of the handlebar 66 along the bottom of the seat 30, particularly in the directions of the arrow in FIG. 5.

FIG. 5 shows the apparatus 24 in the seating position, in which the opposing first and second sides 38, 40 of the seat 30 and opposing first and second sides 46, 48 of the backrest 32 are supported by corresponding seating and backrest supporting ledges 49, 51 (see FIG. 6) on the base 28, which in the illustrated example are provided by the hull 26 of the boat 22. The handle member 70 is conveniently located adjacent to and under the front 34 of the seat 30 such that it is easily manually accessible.

Figure 6:
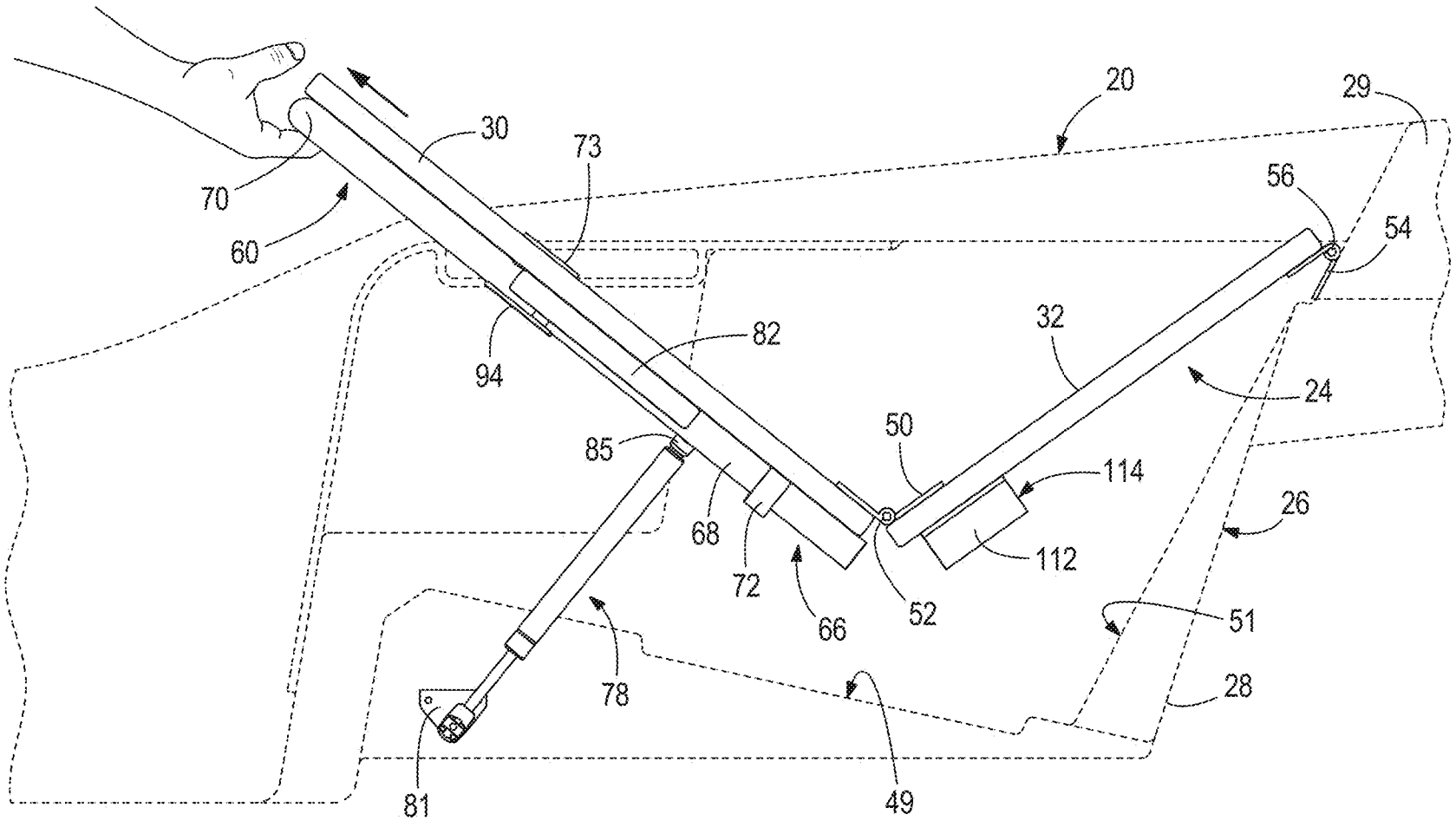
FIG. 6 is a side view showing initial movement of the convertible seating apparatus out of the seating position and towards the lounge position.

When it is desired to move the apparatus 24 into the lounge position, the occupant manually grasps the handle member 70, and pulls outwardly and upwardly in the direction of the arrows in FIGS. 5 and 6. This pivots the seat 30, the first pivot joint 52, and the backrest 32 upwardly about the second pivot joint 56, and moves the first pivot joint 52 upwardly as the seat 30 and backrest 32 are brought into parallel and raised alignment, as shown in FIG. 7.

Movement from the seating position to the lounge position is advantageously assisted by automatic extension of gas spring 78, which has a first rod-end pivotably coupled to the hull 26 via a pivot bracket 81 and an opposite, cylinder-end pivotably coupled to the bottom of the seat 30 via a pivot bracket 85. The bias of the gas spring 78 towards its extended position reduces the lifting force required by the occupant. The bias of the gas spring 78 also advantageously prevents free-fall of the apparatus 24 under force of gravity into the seating position.

Referring to FIGS. 4 and 8-10, the noted primary and secondary locking devices 62, 64 effectively lock the apparatus 24 in the lounge position and help support the weight of the occupant while standing, sitting, or lying thereon. As further described herein below, the primary and secondary locking devices 62, 64 are also both conveniently moved into the locked position via a single manual sliding movement of the handlebar 66 in the direction of the arrow in FIGS. 8 and 10.

The primary locking device 62 includes a pair of locking wings 80 located on opposite sides of the bottom of the seat 30. Each locking wing 80 includes a rectangular plate member 82 having a through-bore 84, an arcuate slot 86 and an angular slot 88. A fastener 93 extends through a through-bore 92 in the seat 30 and into engagement with the through-bore 84 in the plate member 82. The plate member 82 is thus pivotable about a pivot axis defined by the fastener 93. An opposing pair of side flanges 94 laterally extend from the arms 68 of the handlebar 66. A pin 96 protrudes from each side flange 94 into the angular slot 88.

In the unlocked position (FIG. 9), the angular slot 88 extends at an angle to the slots 77 and as such to the above-described sliding movement of the handlebar 66 shown at the arrow in FIG. 8. When the occupant grasps and pushes the handlebar 66 in the direction of arrow in FIG. 8, the side flanges 94 are moved in the direction of the arrow, which in turn pushes the pin 96 against the inner side of the angular slot 88. This applies a camming force on the plate member 82, which rotates the plate member 82 about the pivot axis defined by fastener 93 as the pin 96 slides along the angular slot 88 and until the plate members 82 extends laterally outwardly from the opposite first and second sides 38, 40 of the seat 30, as shown in FIG. 10. The length of the angular slot 88 is configured so that the pin 96 engages an end of the angular slot 88 when the plate member 82 rotates into the position shown in FIG. 9 and conversely so that the pin 96 engages an opposite end of the angular slot 88 when the plate member 82 rotates into the position shown in FIG. 10. Thus the ends of the angular slot 88 provide stop surfaces for stopping the rotation of the plate member 82 into each of the depicted positions.

Referring to FIG. 4, another fastener 102 extends through a through-bore 104 in the seat 30 into engagement with a slide bearing 106 disposed in the arcuate slot 86. The slide bearing 106 remains fixed relative to the seat 30 and slides along the arcuate slot 86 as the plate member 82 rotates about the pivot axis defined by fastener 93. Thus the slide bearing 106 provides a guiding support for smooth and controlled pivoting of the plate member 82. Similar to the angular slot 88, the arc shape and the length of the arcuate slot 86 are configured so that the slide bearing 106 engages an end of the arcuate slot 86 when the plate member 82 rotates into the position shown in FIG. 9 and conversely so that the slide bearing 106 engages an opposite end of the arcuate slot 86 when the plate member rotates into the position shown in FIG. 10. As such the ends of the arcuate slot 86 provide stop surfaces for stopping rotation of the plate member 82 in each of the depicted positions.

Figure 9:
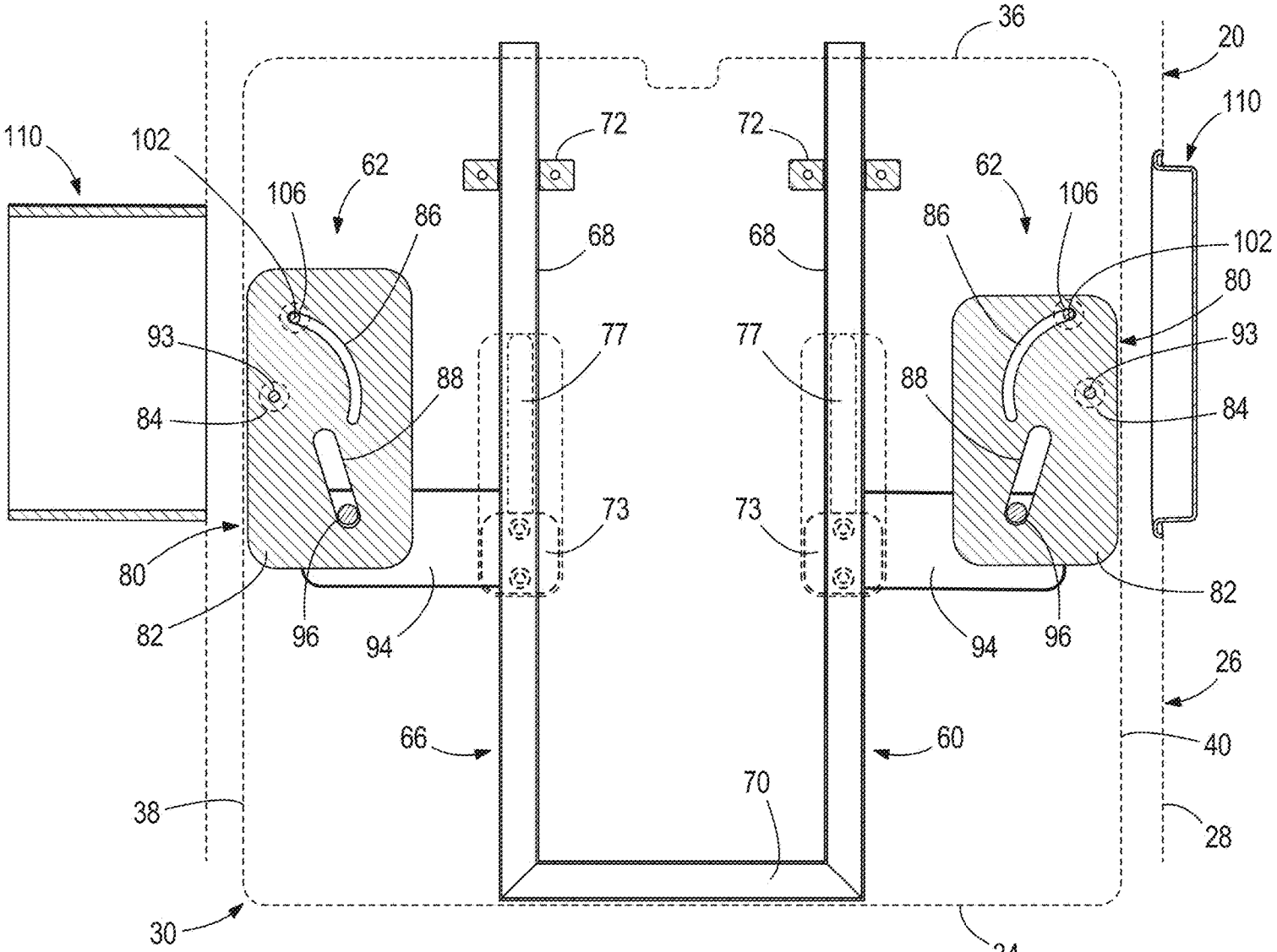
FIG. 9 is a bottom view of a primary locking device for locking the convertible seating apparatus in the lounge position, the primary locking device being in an unlocked position.
Figure 10:
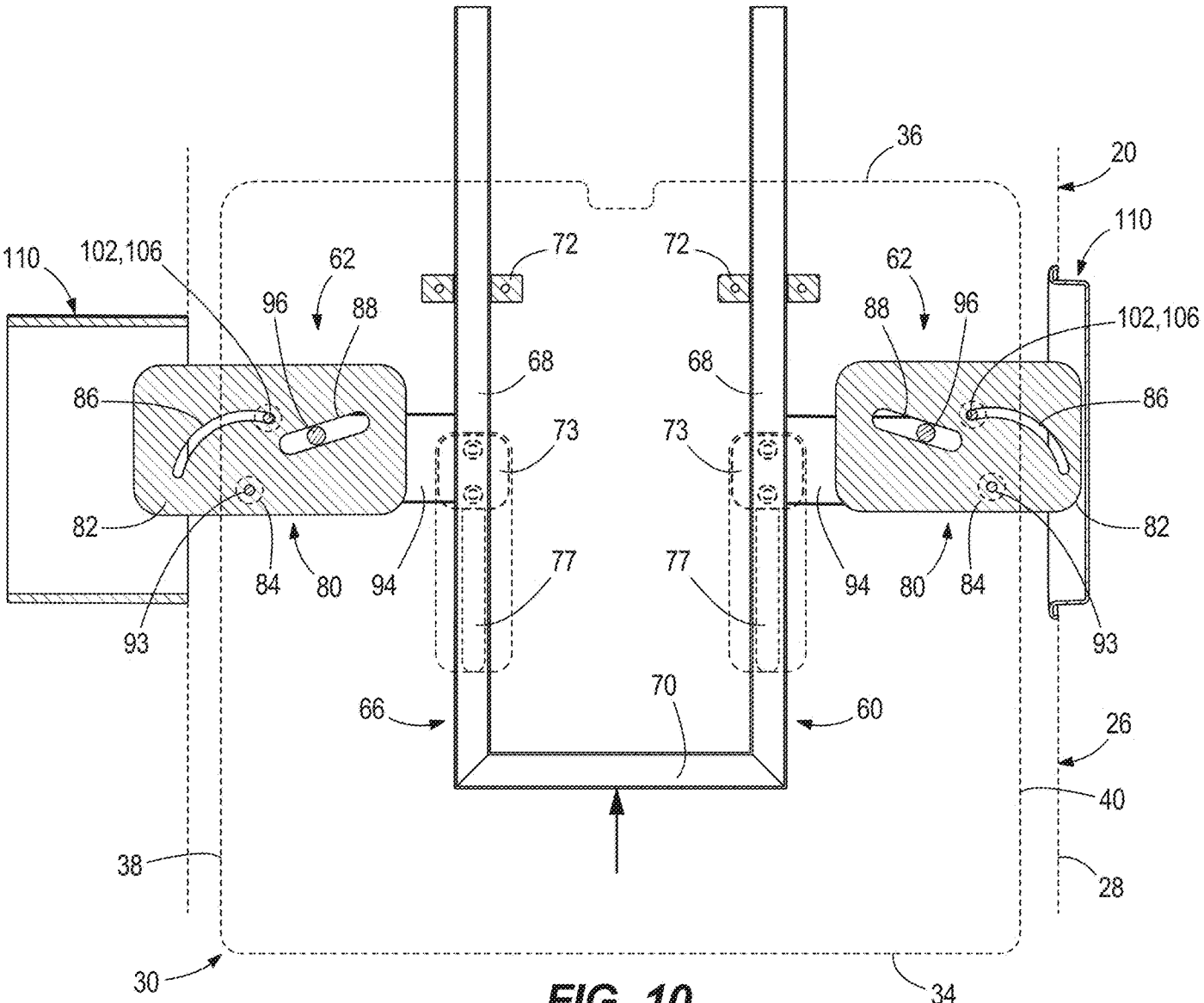
FIG. 10 shows the primary locking device in a locked position.

Referring to FIGS. 9 and 10, the hull 26 has primary locking recesses 110 on opposite sides of the seat 30 in the lounge position. The primary locking recesses 110 are sized to receive the plate members 82 as the locking wings 80 are pivoted into the locked position shown in FIG. 10. In the locked position, the plate members 82 span the lateral gap between the seat 30 and the base 28 and prevent the seat 30 from pivoting downwardly out of the lounging position. The locking wings 80 also support the opposite sides of the seat 30 and are configured to support the weight of an occupant sitting or standing on the seat 30 and/or backrest 32.

Referring to FIGS. 3 and 8, the secondary locking device 64 includes a pair of locking brackets 112 fixed to the back of the backrest 32. The locking brackets 112 define secondary locking recesses 114 sized to receive the ends of the arms 68 when the handlebar 66 is slid in the direction of the arrow. When the ends of the arms 68 are engaged with the locking brackets 112, the arms 68 extend beneath the first pivot joint 52, spanning the gap between the seat 30 and the backrest 32. In this position, the handlebar 66 prevents pivoting of the seat 30 relative to the backrest 32 about the first pivot joint 52 and thus locks the apparatus 24 in the lounge position shown in FIG. 8. The handlebar 66 and various connections are robust enough to support the weight of the apparatus 24 and the occupant seated, standing or lying on the apparatus 24.

Use of the apparatus 24 is thus apparent from the above description and FIGS. 5-10, when viewed in series. In the seated position shown in FIG. 5, the apparatus 24 is supported in the seating position by seating and backrest supporting ledges 49, 51 (see FIG. 6) on the base 28. To convert the apparatus 24 from the seating position to the lounge position, the occupant grasps the handle member 70 and pulls the handle member outwardly and upwardly in the direction of the arrows in FIGS. 5 and 6. Upward pivoting movement of the apparatus 24 is encouraged by automatic extension of gas spring 78 until the seat 30 and backrest 32 reach the position shown in FIG. 7. The occupant can easily lock the apparatus 24 in the lounge position by pushing inwardly on the handle member 70 in the direction of the arrow FIG. 8, which actuates the primary and secondary locking devices 62, 64. In particular, pushing the handle member 70 inwardly cams and thus pivots the locking wings 80 outwardly from the unlocked position shown in FIG. 9 to the locked position shown in FIG. 10, in which the plate members 82 are engaged with the opposing primary locking recesses 110 on the base 28. Pushing the handle member 70 inwardly also engages the ends of the arms 68 of the handlebar 66 in the secondary locking recesses 114 on the backrest 32. In these positions, the primary and secondary locking devices 62, 64 lock the apparatus 24 in the lounge position and also support the weight of the apparatus 24 and the occupant, sitting, standing or lying thereon.

To unlock and move the apparatus 24 from the lounge position to the seating position, the above steps are undertaken in reverse order, including grasping and pulling the handle member 70 in the direction opposite of arrow 100, which cams and thus pivots the locking wings 80 inwardly to the unlocked position shown in FIG. 9 and slides the ends of the arms 68 of the handlebar 66 out of engagement with the secondary locking recesses 114 and until the arms 68 no longer span the gap between the seat 30 and the backrest 32. The occupant can then manually lower the seat 30 and backrest 32 about the first pivot joint 52 until the seating and backrest supporting ledges 49, 51 again support the seat 30 and backrest 32 in the seating position. As explained above, manually lowering the apparatus 24 is supported by the tendency of the gas spring 78 to extend, thus advantageously preventing free fall from the lounge position.

In other examples, the apparatus 24 can include an electromechanical actuator, such as an electric motor for actuating the primary and/or secondary locking devices 62, 64, instead of or in addition to the handle actuator 60. In such arrangements, actuation of the apparatus 24 into and between the seating and lounge positions can be accomplished remotely, for example via an operator input device located at the helm of the boat or elsewhere.

As used herein, "about," "approximately," "substantially," and "significantly" will be understood by persons of ordinary skill in the art and will vary to some extent on the context in which they are used. If there are uses of these terms which are not clear to persons of ordinary skill in the art given the context in which they are used, "about" and "approximately" will mean plus or minus <10% of the particular term and "substantially" and "significantly" will mean plus or minus >10% of the particular term.

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A convertible seating apparatus for a boat, the convertible seating apparatus comprising:

a base, a seat, and a backrest coupled to the seat, wherein the seat and the backrest are both movable relative to the base into and between a seating position in which the backrest extends transversely upwardly relative to the seat and a lounge position in which the backrest and seat are substantially aligned, and a primary locking device that is movable into and between a locked position in which the primary locking device is coupled to the base so as to lock the seat and the backrest in the lounge position, and an unlocked position in which the primary locking device is decoupled from the base so as to permit movement of both the seat and the backrest into and between the seating position and the lounge position.

2. The convertible seating apparatus according to claim 1, wherein the backrest is pivotably coupled to the base at a first pivot joint and pivotably coupled to the seat at a second pivot joint.

3. The convertible seating apparatus according to claim 2, wherein the first pivot joint is configured to pivot about the second pivot joint when the seat and the backrest are moved into and between the seating position and the lounge position.

4. The convertible seating apparatus according to claim 3, wherein the first pivot joint is in a lowered position when the seat and the backrest are in the seating position and wherein the first pivot joint is in a raised position relative to the lowered position when the seat and the backrest are in the lounge position.

5. The convertible seating apparatus according to claim 1, wherein the primary locking device comprises a locking wing, and wherein in the locked position, the locking wing extends from a side of the seat into engagement with a primary locking recess on the base.

6. The convertible seating apparatus according to claim 5, wherein in the unlocked position, the locking wing is removed from the primary locking recess.

7. The convertible seating apparatus according to claim 6, wherein the locking wing is configured to pivot into and between the locked position and the unlocked position.

8. The convertible seating apparatus according to claim 7, wherein the locking wing comprises a plate member that is pivotable relative to the seat about a pivot axis.

9. The convertible seating apparatus according to claim 8, wherein the plate member has an arcuate slot and further comprising a guide member on the seat, wherein the guide member is configured to travel along the arcuate slot as the plate member is pivoted relative to the seat.

10. The convertible seating apparatus according to claim 5, wherein the locking wing is one of a pair of locking wings located on opposite sides of the seat and wherein the primary locking recess is one of a pair of primary locking recesses on opposite sides of the seat, and further wherein in the locked position the pair of locking wings extends from the opposite sides of the seat into engagement with the pair of primary locking recesses.

11. The convertible seating apparatus according to claim 1, further comprising an actuator configured to move the primary locking device into and out of the locked position and the unlocked position, wherein the actuator is movable into and between an engaged position to support the seat and the backrest in the lounge position and a disengaged position to permit movement of the seat and the backrest into the seating position.

12. The convertible seating apparatus according to claim 11, wherein the actuator comprises a handle that is manually operable.

13. The convertible seating apparatus according to claim 5, wherein the locking wing is cammed into and out of the locked position and the unlocked position.

14. The convertible seating apparatus according to claim 13, further comprising an angular slot and a pin, wherein movement of an actuator causes the pin to cam the locking wing into and out of the locked position and the unlocked position.

15. The convertible seating apparatus according to claim 11, further comprising a secondary locking device configured to lock the seat and the backrest in the lounge position.

16. The convertible seating apparatus according to claim 15, wherein the actuator is on the seat and wherein the secondary locking device comprises a secondary locking recess that engages the actuator when the seat and the backrest are in the lounge position.

17. The convertible seating apparatus according to claim 16, wherein the secondary locking recess is on the backrest.

18. The convertible seating apparatus according to claim 16, wherein the actuator comprises a handle that is slide-able relative to the seat and wherein the secondary locking recess is defined by a bracket on the backrest that receives the handle in the locked position.

19. The convertible seating apparatus according to claim 1, further comprising a gas-spring that assists movement of the seat and the backrest into the lounge position and prevents free fall of the seat and the backrest under force of gravity into the seating position.

20. The convertible seating apparatus according to claim 19, wherein the gas-spring is coupled at one end to the base and at an opposite end to the seat.

21. A convertible seating apparatus for a boat, the convertible seating apparatus comprising:

a base, a seat, a backrest coupled to the seat, wherein the seat and the backrest are positionable relative to the base into and between a seating position in which the backrest extends transversely upwardly relative to the seat and a lounge position in which the backrest and seat are substantially aligned, a primary locking device that is movable into and between a locked position in which the seat is coupled to the base so as to lock the seat and the backrest in the lounge position, and an unlocked position in which the seat is decoupled from the base so as to permit movement of both the seat and the backrest into and between the seating position and the lounge position, and a secondary locking device that is movable into and between a locked position in which the seat is coupled to the backrest so as to lock the seat and the backrest in the lounge position, and an unlocked position in which the seat is decoupled from the backrest so as to permit movement of both the seat and the backrest into and between the seating position and the lounge position.

22. The convertible seating apparatus according to claim 21, further comprising an actuator that simultaneously actuates both of the primary locking device and the secondary locking device.

23. The convertible seating apparatus according to claim 22, wherein the actuator comprises a manually-operable handle.

24. The convertible seating apparatus according to claim 22, wherein the primary locking device comprises a locking wing, and wherein in the locked position, the locking wing extends from a side of the seat into engagement with a primary locking recess on the base.

25. The convertible seating apparatus according to claim 24, further comprising a gas-spring that assists movement of the seat and the backrest into the lounge position and prevents free fall of the seat and the backrest under force of gravity into the seating position.

* * * * *